US006423903B1

(12) United States Patent
Tapani

(10) Patent No.: US 6,423,903 B1
(45) Date of Patent: Jul. 23, 2002

(54) METHOD AND ARRANGEMENT FOR MINIMIZING ELECTRICAL FIELD STRESS IN CIRCUIT INTERRUPTERS AND HOUSINGS THEREFOR

(75) Inventor: Arno J. Tapani, Chicago, IL (US)

(73) Assignee: S & C Electric Company, Chicago, IL (US)

( * ) Notice: Subject to any disclaimer, the term of this patent is extended or adjusted under 35 U.S.C. 154(b) by 0 days.

(21) Appl. No.: 09/706,143

(22) Filed: Nov. 3, 2000

Related U.S. Application Data

(60) Provisional application No. 60/165,415, filed on Nov. 13, 1999.

(51) Int. Cl.[7] ..... H01B 17/26

(52) U.S. Cl. ..... 174/142; 174/138 R; 174/140 R; 174/174; 174/212

(58) Field of Search ..... 174/138 R, 142, 174/143, 144, 167, 171, 172, 174, 178, 179, 209, 212

(56) References Cited

U.S. PATENT DOCUMENTS

| | | | | | |
|---|---|---|---|---|---|
| 1,273,015 | A | * | 7/1918 | Thomas | 174/140 R |
| 1,350,925 | A | * | 8/1920 | Faccioli | 174/142 |
| 1,491,385 | A | * | 4/1924 | Faccioli | 174/142 |
| 2,423,596 | A | * | 7/1947 | Hollingsworth | 174/143 |
| 2,732,419 | A | * | 1/1956 | Wilson | 174/142 |
| 2,820,086 | A | * | 1/1958 | Nicholas | 174/140 R |
| 2,821,568 | A | * | 1/1958 | Smith | 174/138 R |
| 3,104,278 | A | * | 9/1963 | Huston et al. | 174/167 |
| 3,604,830 | A | * | 9/1971 | Frakes | 174/143 |
| 5,695,841 | A | * | 12/1997 | Mazeike et al. | 174/176 |

* cited by examiner

*Primary Examiner*—Dean A. Reichard
*Assistant Examiner*—Adolfo Nino
(74) *Attorney, Agent, or Firm*—James V. LaPacek

(57) ABSTRACT

A method and arrangement is provided for minimizing electrical field stress on circuit interrupters and their housings via the arrangement of the external sheds or skirts of the housing. In one arrangement, some of the sheds are grouped about each side of the open gap that is defined by the contacts of the circuit interrupter in an open position.

3 Claims, 5 Drawing Sheets

METHOD AND ARRANGEMENT FOR MINIMIZING ELECTRICAL FIELD STRESS IN CIRCUIT INTERRUPTERS AND HOUSINGS THEREFOR

This application claims the benefit of U.S. Provisional Application No. 60/165,415 filed on Nov. 13, 1999.

BACKGROUND OF THE INVENTION

1. Field of the Invention

The present invention relates generally to the field of electrical circuit interrupters for electrical power transmission and distribution, and more particularly to a method and arrangement for minimizing electrical field stress on circuit interrupters and their housings via the arrangement of the external sheds or skirts of the housing.

2. Description of the Related Art

Various circuit interrupters are known for the electrical power transmission and distribution field. For outdoor application, the insulating housings of these circuit interrupters include external sheds or skirts to satisfy desired power-frequency voltage withstand ratings in a variety of environmental conditions. As the diameter of such housings is decreased, high electric field stresses inside of the housing also appear on the exterior of the housing. At the desired BIL (basic insulation level) rating, the external electric field stresses must not exceed the breakdown level of air or other specified environment.

SUMMARY OF THE INVENTION

Accordingly, it is a principal object of the present invention to provide a method and arrangement for minimizing electrical field stress on circuit interrupters and their housings via the arrangement of the external sheds or skirts of the housing.

It is another object of the present invention to provide a grouping of external sheds on either side of the open gap defined by the open contacts of a circuit interrupter.

It is a further object of the present invention to provide a housing for a circuit interrupter that reduces the electrical field stress on the exterior of the housing via the grouping of sheds around the open contracts of the circuit interrupter.

These and other objects of the present invention are efficiently achieved by the provision of a method and arrangement for minimizing electrical field stress on circuit interrupters and their housings via the arrangement of the external sheds or skirts of the housing compared to a uniform spacing off the external sheds or skirts. In one arrangement, some of the sheds are grouped about each side of the open gap that is defined by the contacts of the circuit interrupter in an open position, i.e. increasing the leakage distance per unit length of the housing around the open gap compared to the middle of the open gap and other areas of the housing.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
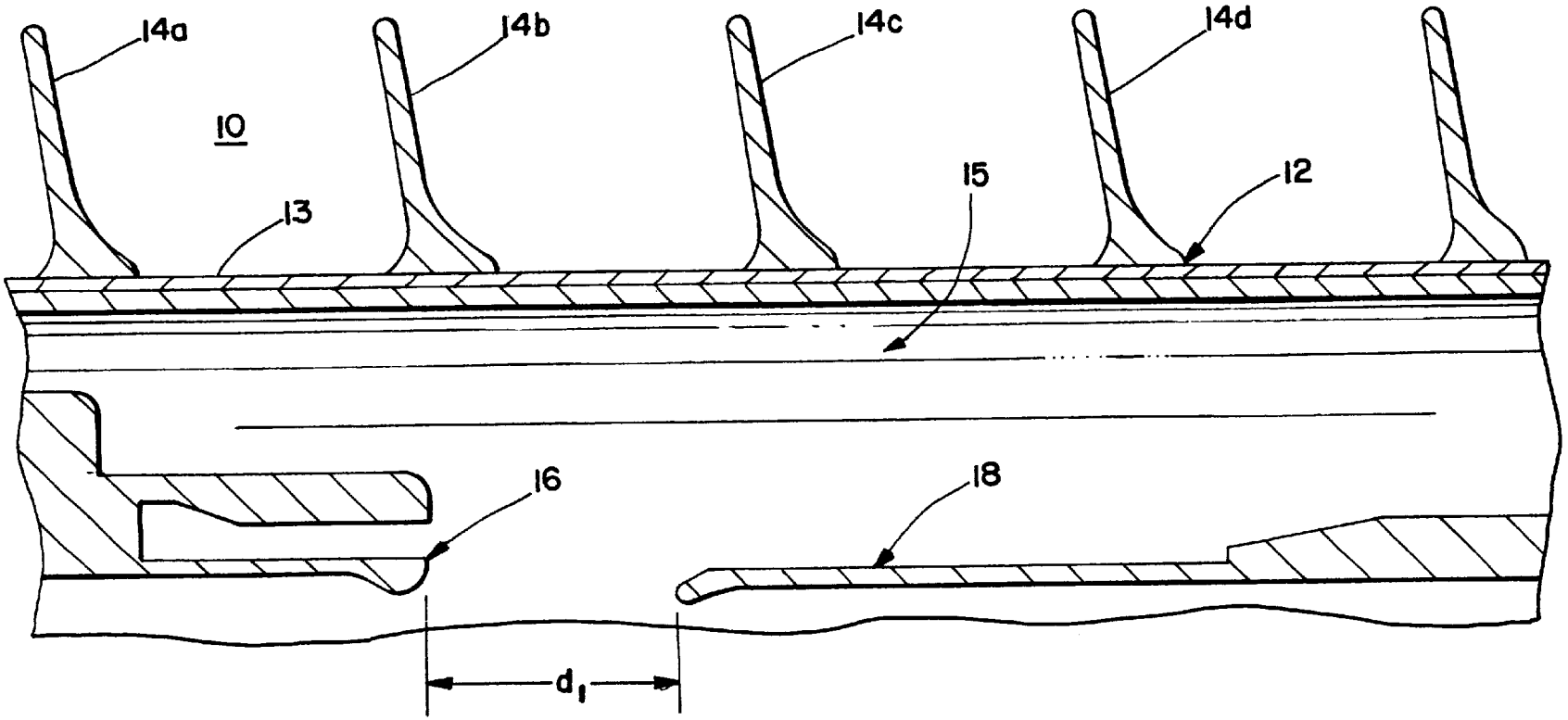
Fig. 1 (PRIOR ART)
FIG. 1 is a cut-away view of a circuit interrupter with a housing having a pattern of external sheds in accordance with the prior art.

Referring now to FIG. 1, there is illustrated a circuit interrupter 10 including a housing 12 generally in accordance with the prior art. In specific implementations, the interior 15 of the housing 12 is filled with pressurized gas, e.g. $SF_6$. The housing 12 includes external sheds or skirts 14, e.g. 14*a, b, c* and *d* to satisfy power-frequency voltage withstand ratings in a variety of environmental conditions, e.g. to prevent external flashover of the circuit interrupter 10 due to the effects of precipitation and pollution. The diameter and spacing of the sheds 14 is varied in accordance with the desired ratings. For example, as known by those skilled in the art and as set forth in various standards etc., to achieve a particular power-frequency voltage withstand rating, a minimum creepage distance along the exterior of the housing 12 is required to achieve a particular rating, i.e. avoid flashover when a specified voltage is impressed across the interrupter 10. This may be achieved by differing numbers of sheds of various diameters as long as the overall total creepage distance is achieved. Further, the sheds need not be evenly spaced.

The circuit interrupter 10 includes relatively movable contacts 16, 18 carried within the interior 15 of the housing 12. The contacts 16, 18, which are shown in an open position in FIG. 1 so as to define an open gap d1, are connected to respective terminals of the electrical power system. In such electrical power systems, the contacts 16, 18, when open, as shown in FIG. 1, may be energized at significantly different system voltage potentials. The external electric field stresses must not exceed the breakdown level of air in order to pass BIL testing and ensure the avoidance of flashovers. As the diameter of the housing 12 is decreased to minimize size and material usage, high electrical field stresses inside the housing 12 begin to appear on the outside 13 of the housing 12.

Figure 2:
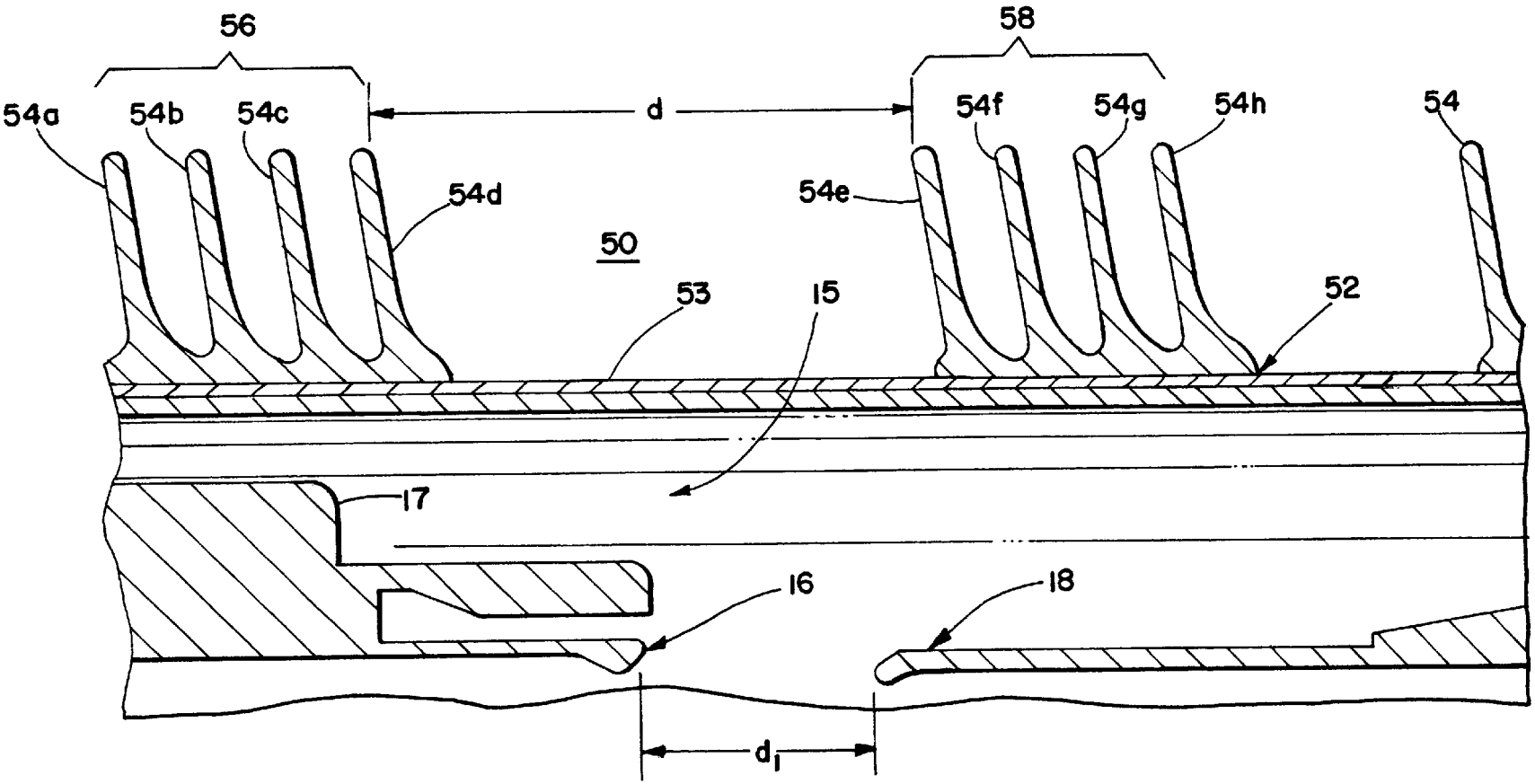
FIG. 2 is a cut-away view of a circuit interrupter with a housing having a pattern of external sheds in accordance with the present invention.

In accordance with important features of the present invention and referring now to FIG. 2, it has been found that these external electric field stresses may be reduced and thus a housing 52 of smaller diameter can be utilized for a circuit interrupter 50. These features of the present invention are achieved by the provision of a predetermined grouping of the external sheds 54, e.g. 54*a* to 54*h*, which may also be characterized as a non-uniform pattern. The predetermined pattern includes the spacing and/or grouping of the external sheds 54. For example, in the illustrative embodiment of FIG. 2, the sheds 54 are grouped in the vicinity of and about the open gap of the contacts 16, 18, as denoted by groups 56, 58. Additionally, it has been found that it is preferable to have a minimum spacing d2 between the grouped sheds, 56, 58 that is greater than or equal to the open gap d1 defined between the contacts 16, 18 when in the open position.

For example, the arrangement of FIG. 1 results in relatively high and undesirable electrical field stresses on the exterior 13 of the housing 12 in the vicinity of the contacts 16, 18 while in FIG. 2 the electric field stresses are satisfactorily reduced. Specifically, for a BIL rating of 650,000 volts, while the stresses in the arrangement of FIG. 1 result in electrical field stress on the exterior 13 of the housing 12 that exceed 4000 volts/mm, this is reduced to approximately 3500 volts/mm for the interrupter 50 of FIG. 2, i.e. on the exterior 53 of the housing 52.

In accordance with other important aspects of the present invention, it should be noted that the spacing of each shed 54 in each of the groups 56, 58 is substantially less than that which results from an even spacing of the number of sheds 14 along the housing 12 of the interrupter 10 of FIG. 1 that are required to meet the BIL rating. Accordingly, the present invention can be practiced by using the required number of sheds 54 to meet BIL ratings and spacing the sheds 54 in a non-uniform manner to achieve the groups 56, 58 and arranging the remaining number of sheds 54 at various positions along the exterior 53 of the housing 52, e.g. uniformly or non-uniformly. Again, it should be noted that the grouping of the sheds 54 as illustrated by FIG. 2 is not required either for exterior environmental reasons or for internal reasons when the interrupter contacts 16, 18 are closed. Instead, the grouping of the sheds 54 is desirable to minimize stress on the exterior 53 of the housing 52 when the contacts 16, 18 are open.

While the spacing d2 between the groups of sheds 56, 58 as shown in FIG. 2 may be varied without undesirable effects, e.g. in a range of 10–20% from that shown in FIG. 2, substantially greater or less spacing than that illustrated in FIG. 2 does begin to increase the electrical field stress and reduce the desirable features achieved by the grouped sheds. Additionally, it has been found that the geometry of the contacts 16, 18 also influences the desirable spacing of the groups 56, 58. For example, for a contact such as 16 that includes a relatively abrupt increase in size at 17 benefits from a spacing d2 that is larger and offset toward the contact 16 than if the contact 16 were of uniform diameter at the region 17. The spacing between each shed 54 within the groups 56, 58 must also not be too large, e.g. less than a substantial portion of the open gap distance d1 in order to avoid undesirable electrical field stress from occurring on the exterior of the housing 54.

Figure 3:
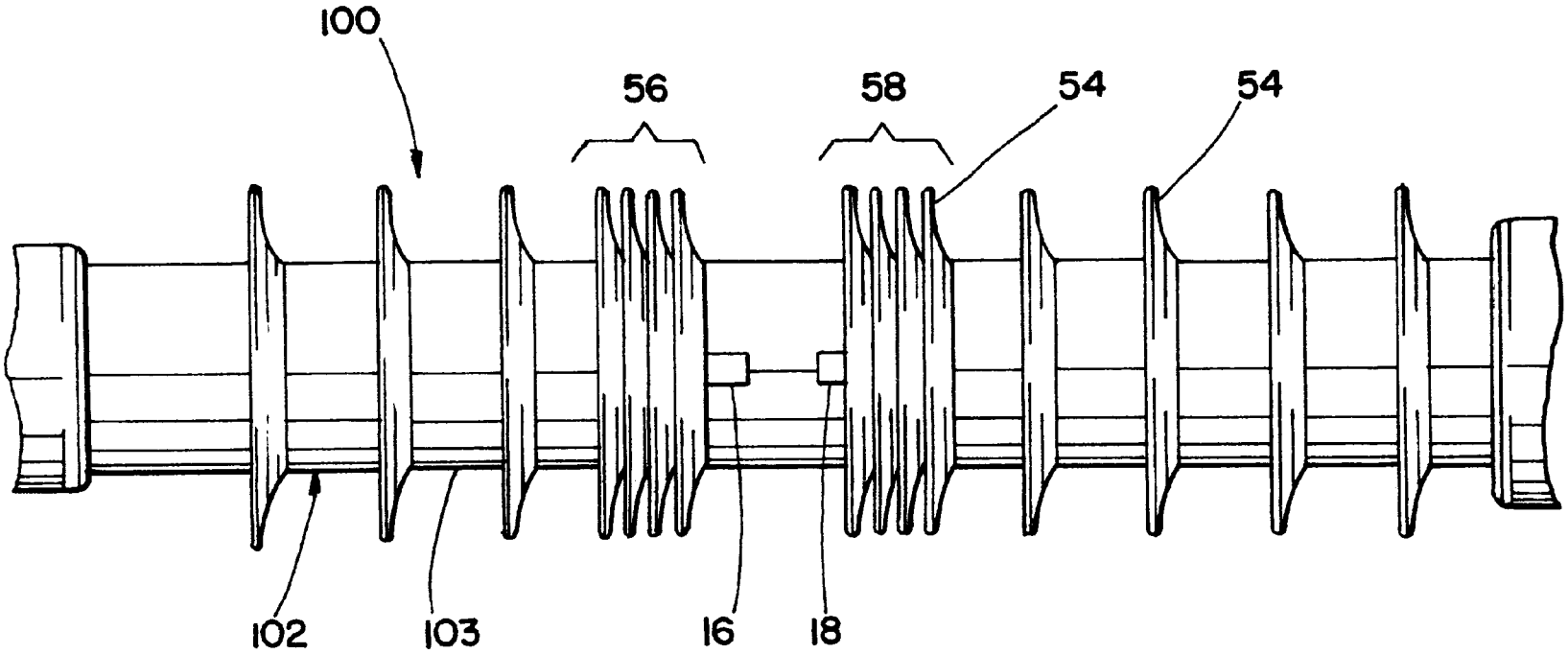
FIGS. 3–5 are elevational views of alternate embodiments of the present invention illustrating circuit interrupters with respective housings and illustrating different patterns or grouping of external sheds.
Figure 4:
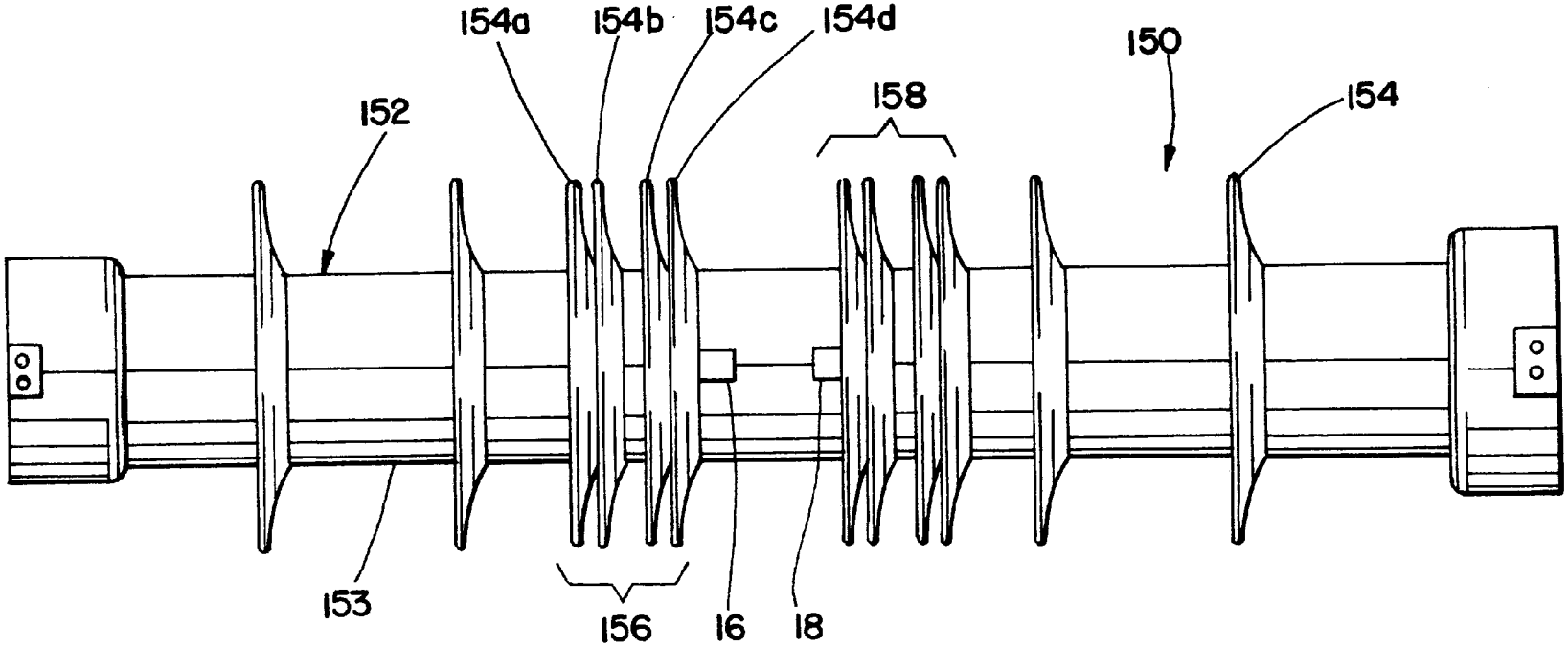
Figure 5:
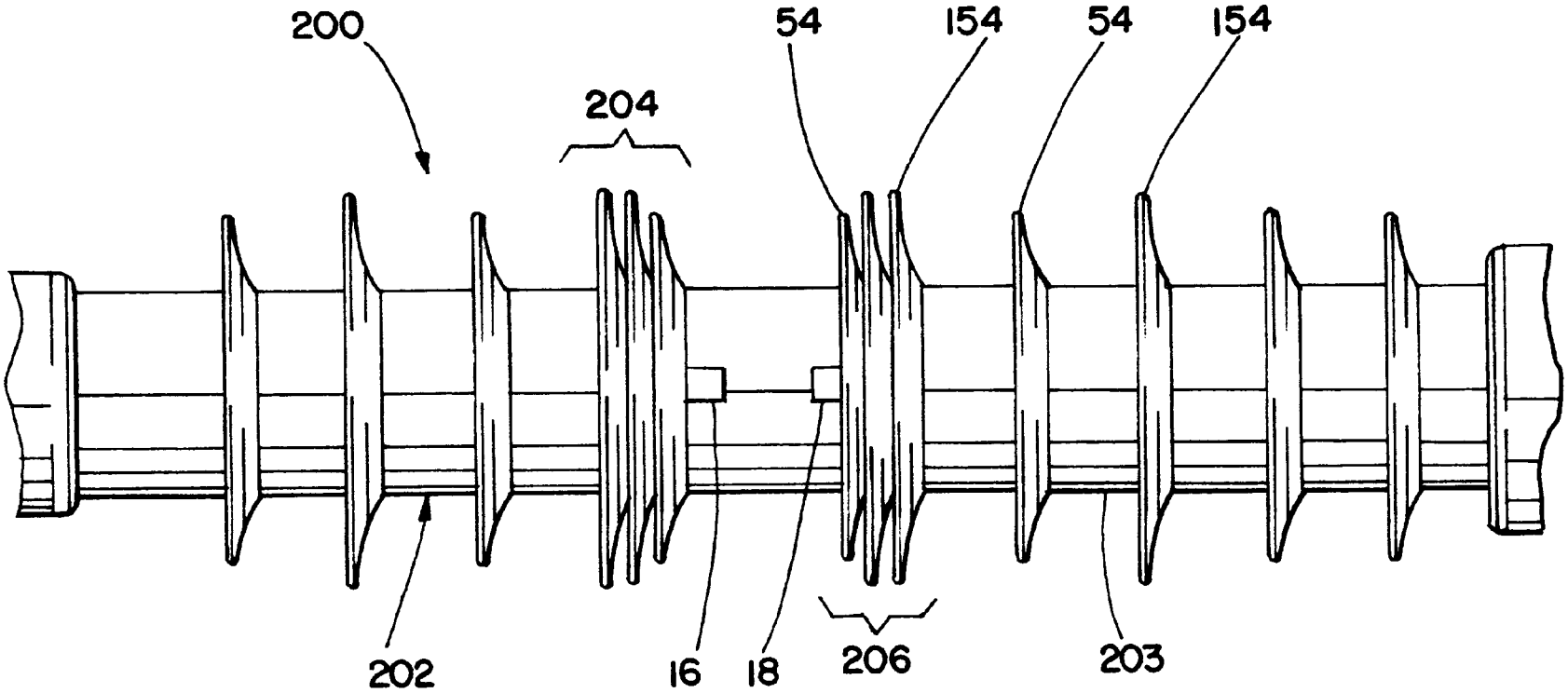

In accordance with other important aspects of the present invention and referring now additionally to FIGS. 3–5, the scope of the present invention is illustrated by different patterns, sizes, and/or grouping of sheds including sheds of diverse diameter on a particular housing. For example, the circuit interrupter 100 of FIG. 3 with housing 102 illustrates the general arrangement as in FIG. 2 with groupings 56, 58 about the contacts 16, 18 and a relatively uniform spacing of sheds 54 along the remaining portions 103 of the housing 102, all of the sheds 54 being of the same diameter. This is useful where it is desirable to utilize only one size shed, e.g. for molding or manufacturing purposes. The interrupter 150 of FIG. 4 illustrates the use of larger diameter sheds 154 as compared to the sheds 54 of FIG. 3, with groupings 156, 158 about the open gap of the contacts 16, 18. For this specific illustrative embodiment, it has been found useful to space the sheds 154 within the groupings 156, 158 so as to minimize electrical field stress on the exterior 153 of the housing 152 in the vicinity of the open gap. For example, the sheds 154 within each of the groupings 156, 158 include non-uniform spacing such that the spacing between the sheds 154*b* and 154*c* is greater than the spacing between the sheds 154*a* and 154*b* and the spacing between the sheds 154*c* and 154*d,* which are more closely spaced such as the smaller sheds 54 in FIG. 2. The arrangement of FIG. 5 illustrates the use of both the smaller sheds 54 and the larger sheds 154. Specifically, as before, the sheds are grouped about the open gap of the contacts 16, 18 with groupings 204, 206. Each of the groupings 204, 206 utilizes a smaller shed 54 adjacent the contacts 16, 18 respectively and two larger sheds 154. This arrangement has been found useful to minimize the electric field stress on the exterior 203 of the housing 202 in the vicinity of the open gap of the contacts 16, 18 of the interrupter 200. It should be noted that the arrangement of FIG. 5 utilizes only 3 sheds per grouping to achieve the same results as the arrangement in FIGS. 3 and 4 that require 4 sheds per grouping.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed is:

1. A method for minimizing electric field stress on the exterior of a housing for a circuit interrupter, the housing having external sheds and the circuit interrupter including relatively movable contacts that have an open position defining an open gap therebetween, the method comprising grouping external sheds about the vicinity of the open gap defined by the contacts, wherein said sheds in the grouping being more closely spaced than the spacing at other portions of said housing.

2. The method of claim 1 wherein said grouping is defined by a group of sheds on either side of the open gap and separated by a distance approximately equal to the open gap.

3. A housing for a circuit interrupter that includes relatively movable contacts that define an open gap in an open position, the housing having an exterior and comprising a predetermined spacing of external sheds in the vicinity of the contacts of the circuit interrupter so as to minimize electric field stress on the exterior of the housing, said predetermined spacing comprising a non-uniform spacing of said external sheds over an area defined about the open gap of the interrupter contacts with adjacent sheds in said non-uniform spacing being more closely spaced than a uniform spacing that would be required for power-frequencyvoltage withstand ratings.

* * * * *